US008362376B2

(12) United States Patent
Sen et al.

(10) Patent No.: US 8,362,376 B2
(45) Date of Patent: Jan. 29, 2013

(54) ELECTROSTATICALLY DRIVEN HIGH SPEED MICRO DROPLET SWITCH

(75) Inventors: Prosenjit Sen, Los Angeles, CA (US); Chang-Jin Kim, Beverly Hills, CA (US)

(73) Assignee: The Regents of the University of California, Oakland, CA (US)

( * ) Notice: Subject to any disclaimer, the term of this patent is extended or adjusted under 35 U.S.C. 154(b) by 660 days.

(21) Appl. No.: 12/523,419

(22) PCT Filed: Jan. 15, 2008

(86) PCT No.: PCT/US2008/051094

§ 371 (c)(1), (2), (4) Date: Jul. 16, 2009

(87) PCT Pub. No.: WO2008/147576

PCT Pub. Date: Dec. 4, 2008

(65) Prior Publication Data

US 2010/0025207 A1 Feb. 4, 2010

Related U.S. Application Data

(60) Provisional application No. 60/885,826, filed on Jan. 19, 2007.

(51) Int. Cl.
*H01H 29/00* (2006.01)

(52) U.S. Cl. ..... 200/182

(58) Field of Classification Search ..... 200/182
See application file for complete search history.

(56) References Cited

U.S. PATENT DOCUMENTS 6,323,447 B1 11/2001 Kondoh et al.
6,559,420 B1 5/2003 Zarev
6,946,776 B2 * 9/2005 Fong et al. ..... 310/328
7,005,593 B2 2/2006 Gasparyan et al.
7,030,328 B1 4/2006 Beerling
7,132,614 B2 11/2006 Beerling
7,271,688 B1 9/2007 Beerling et al.

FOREIGN PATENT DOCUMENTS

WO WO 2006/057780 A2 6/2006
WO WO 2006/068744 A2 6/2006

(Continued)

OTHER PUBLICATIONS

PCT International Preliminary Report on Patentability (Chapter I of the Patent Cooperation Treaty) for PCT/US2008/051094, Applicant: The Regents of the University of California, Form PCT/IB/326 and 373, dated Jul. 30, 2009 (6 pages).

(Continued)

*Primary Examiner* — Renee Luebke
*Assistant Examiner* — Lheiren Mae Caroc
(74) *Attorney, Agent, or Firm* — Vista IP Law Group LLP

(57) ABSTRACT

An electrostatically driven high-speed micro droplet switch includes a substrate having an upper surface containing one or more signal electrodes that are selectively connected via a droplet. The switch includes at least one actuation electrode disposed beneath the upper surface of the substrate, the at least one actuation electrode operatively coupled to drive circuitry. The switch includes a frame disposed on or above the upper surface of the substrate that is configured to hold the droplet in substantially the same location during operation of the switch. In one aspect, the frame is configured to absorb variations in the volume of the droplet placed on the switch, leaving the active meniscus not affected by the variation in volume.

28 Claims, 11 Drawing Sheets

FOREIGN PATENT DOCUMENTS

WO WO 2006/118703 A1 11/2006

OTHER PUBLICATIONS

Kim, J. et al., A Micromechanical Switch with Electrostatically Driven Liquid-Metal Droplet, Proc. Int. Conf. Solid-State Sensors and Acutators (Transducers '01), Jun. 2001, Munich, Germany, pp. 748-751.

Edwards, R.T. et al., Breaking the Resistivity Barrier, Proc. The 3rd NASA/Dod Workshop on Evolvable Hardware, Jul. 2001, Pasadena, CA, pp. 167-171.

Kim, J. et al., A Micromechanical Switch with Electrostatically Driven Liquid-Metal Droplet, Sensors and Actuators, vol. A97-98, pp. 672-679, 2002.

Shen, W. et al., Controlling the Adhesion Force for Electrostatic Actuation of Microscale Mercury Drop by Physical Surface Modification, IEEE 2002, pp. 52-55.

Shen, W. et al., Mercury Droplet Microswitch for Re-Configurable Circuit Interconnect, Proc. Int. Conf. Solid State Sensors, Actuators and Microsystems (Transducers '03), Boston, Jun. 8-12, 2003, pp. 464-467.

Shen, W. et al. Fabrication, Packaging and Charaterization of Mercury Droplet Switches Integrated on CMOS Chip, Presented at ASME Int. Mechanical Engineering Congress and Exposition, Anaheim, CA, Nov. 2004; pp. 1-6.

Sen, P. et al., Electrostatic Fringe-Field Actuation for Liquid-Metal Droplets, Proc. Int. Conf. Solid State Sensors, Actuators and Microsystems (Transducer '05), Seoul, Korea, Jun. 2005, pp. 705-705.

Shen, W. et al., Electrostatically Actuated Metal-Droplet Microswitches Integrated on CMOS Chip, Journal of Microelectromechanical System, vol. 15, No. 4, Aug. 2006, pp. 879-889.

Sen, P. et al., A Fast Liquid-Metal Droplet Switch Using EWOD, IEEE Conf. MEMS, Kobe, Japan, Jan. 2007, pp. 767-770.

PCT International Search Report for PCT/US2008/051094, Applicant: The Regents of the University of California, Form PCT/ISA/210 and 220, dated Sep. 18, 2008 (4 pages).

PCT Written Opinion of the International Search Authority for PCT/US2008/051094, Applicant: The Regents of the University of California, Form PCT/ISA/237, dated Sep. 18, 2008 (6 pages).

* cited by examiner

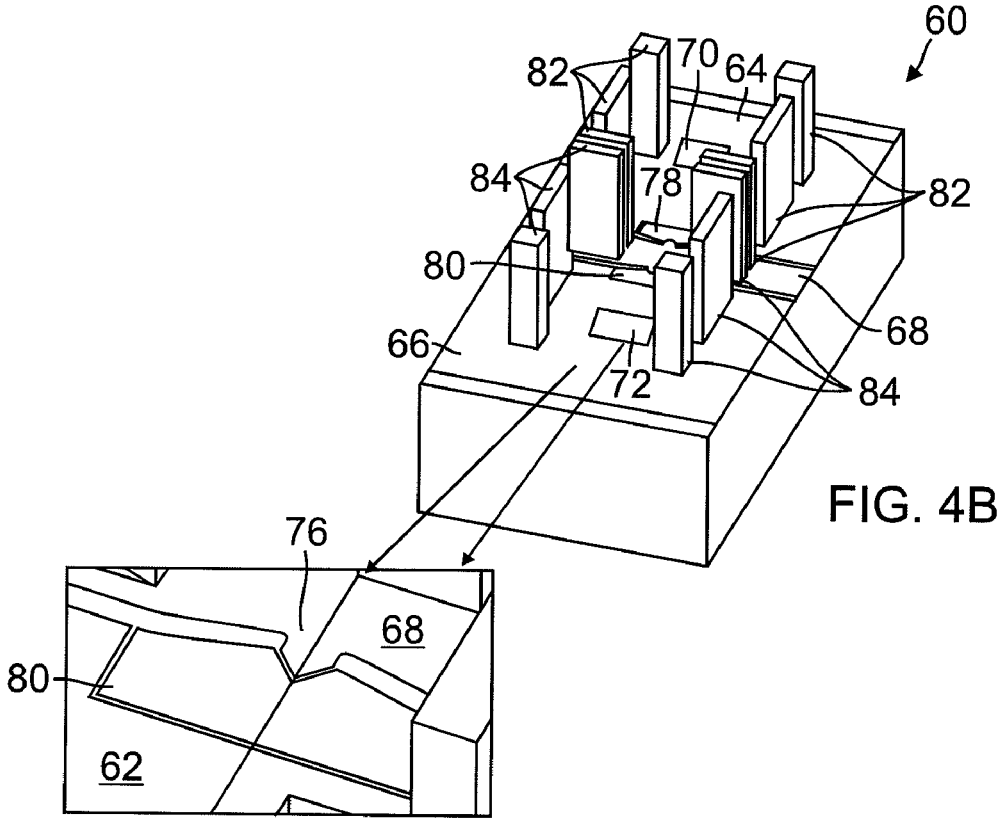
FIG. 4B
FIG. 4C
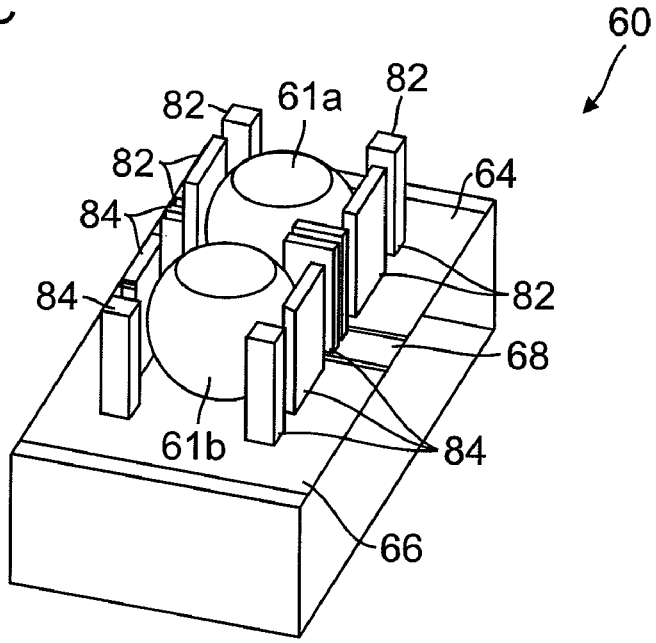
FIG. 4D

ELECTROSTATICALLY DRIVEN HIGH SPEED MICRO DROPLET SWITCH

REFERENCE TO RELATED APPLICATIONS

This Application is a U.S. National Stage filing under 35 U.S.C. §371 of International Application No. PCT/US2008/051094, filed Jan. 15, 2008, which claims priority of U.S. Provisional Patent Application No. 60/885,826 filed on Jan. 19, 2007. The contents of the aforementioned applications are incorporated by reference as if set forth fully herein. Priority to the aforementioned application is hereby expressly claimed in accordance with 35 U.S.C. §§119, 120, 365 and 371 and any other applicable statutes.

STATEMENT REGARDING FEDERALLY SPONSORED RESEARCH AND DEVELOPMENT

This invention was made with Government support under Grant No. N66001-05-1-8908 and N66001-07-01-2027 awarded by the Department of the Navy. The Government has certain rights in this invention.

FIELD OF THE INVENTION

The field of the invention generally relates to micro switches and in particular micromechanical switches. More particularly, the field of the invention relates to micro liquid-metal switches.

BACKGROUND OF THE INVENTION

Conventional semiconductor transistors are well known in their ability to provide high speed switching capability in a relatively inexpensive and small size. Conventional semiconductor-based transistors do, however, suffer from various problems that are not present in mechanical microswitches. Mechanical switches, moreover, include many promising properties that semiconductor transistors lack. For example, micromechanical switches can be built to have a very high "off" resistance and a low "on" resistance resulting in lower loss and less power dissipation. This feature is particularly advantageous because certain applications (e.g., radio frequency applications) require higher electrical isolation between components. Another advantage offered by mechanical switches is that they are more linear and stable with respect to a wide variety of operating conditions such as voltage, current, temperature, pressure, and radiation.

Various micro-electrical-mechanical (MEMS) switches have been proposed and developed for switching applications. Despite the variations in detailed designs and actuation methods, almost all the MEMS-based microswitches utilize microscale beam structures. These types of microswitches operate with solid-to-solid contact between elements, sharing many typical problems of macroscale mechanical switches such as surface degradation (leading to an increase in the contact resistance) and signal bounce effects during switch actuation.

The use of conductive droplet systems has been proposed to overcome these limitations, liquid metals being the droplet material for most applications. In these systems, a metallic droplet such as mercury is physically moved by typically an electrical actuation toward a contact element in a microswitch. The droplet systems generally offer low contact resistance, linear responses, and long lifetimes. Unfortunately, existing droplet-based microswitches have limited application because of the slower switching speeds. An important aspect of the switching speed is switch latency, referring to the amount of time that elapses between actuation of the switch and the closing of the switch. In the case of droplet microswitches, the closing is effectuated by droplet movement. Consequently, their latency tends to be larger (slower) than that of the solid beam-based micro switches and much slower than that of semiconductor switches. In these metallic droplet systems, the lowest reported latency period is on the order of 1 millisecond. See e.g., W. Shen et al., Electrostatically Actuated Metal-Droplet Microswitches Integrated on CMOS Chip, J. MEMS, Vol. 14, No. 4, August 2006, pp. 879-889. There thus is a need for metal-droplet microswitches that have faster switching rates. For example, switching rates at or below around 100 μs (micro seconds) would enable microswitches to be used in many more applications such as, for instance, RF switches and dynamic displays. Such switches would have high performance characteristics of, for instance, high durability, low resistance, no signal bounce, in addition to the high speed switching capability that has heretofore been unrealized in existing metal-droplet switches.

SUMMARY OF THE INVENTION

The speed at which a given micro droplet switch can operate is a function of several parameters including the speed at which the droplet travels and the distance it must travel before making contact with a signal electrode (e.g., to close the switch). While the known practice is to move the droplet, or move the center of mass of the droplet to express exactly, toward the signal electrode, the present invention keeps the droplet substantially stationary and instead moves (i.e., spreads) only the droplet contact line toward the signal electrode. As used herein, the droplet contact line refers to the peripheral interface between the droplet used in the microswitch and the substrate on which the droplet is placed. To accommodate the new type of micro droplet switch disclosed herein, the speed at which a given micro droplet switch can operate is a function of several parameters including the speed at which the droplet contact line can travel as well as the distance the contact line must travel before making contact with a signal electrode.

In order to achieve high speed movement of the contact line, a large actuation force may be used to a certain degree, after which it is limited by other fundamental complications as well as practical design challenges. In order to achieve small distance to travel, the droplet contact line should be placed as close as possible to the signal electrode reliably. Unfortunately, the droplet cannot be formed, deposited, or defined by standard photolithographic semiconductor fabrication techniques, forcing one to use much larger switching gaps. The challenges of placing the droplet contact line on an exact location originate from the difficulties in: (1) accurately positioning the droplet on the switch, (2) depositing a droplet with an accurate volume or size, and (3) positioning and keeping the contact line on the exact location against physical disturbances and surface conditions. For example, considering (1) and (2) above, conventional droplet deposition techniques are problematic because it is difficult, if not impossible, to deposit the correct volume of droplet material on the precise location, when compared with the sub-micrometer accuracies the lithographic techniques allows for the rest of features on the microdevice. If too much droplet material is deposited, even on the exact location on the switch, the actuation gap (the distance to travel for the droplet contact line) may narrow too much or be inadvertently closed without actuation. Overall, there is a need to maintain a substantially constant actuation gap between the contact line of the droplet and the signal electrode.

The micro droplet switch described herein solves the above-identified deficiencies by providing a frame structure that places the droplet on a location accurately defined by the frame fabrication method. After the droplet placement, the frame further restricts unwanted free motion of the droplet on the surface of the micro switch. In this regard, during operation of the microswitch, the droplet remains in substantially the same location—there is no bulk or translational movement of the entire droplet as in other micro droplet switch devices. The frame structure is also designed, in one aspect of the invention, to produce a buffering meniscus in the non-active portion of the droplet. The buffering meniscus is able to buffer variations in the volume of the droplet that is applied to the micro droplet switch. In this regard, the buffering meniscus accepts the excess or deficiency in fluid volume so as to leave the active meniscus substantially unmodified. In one aspect of the invention, the buffering meniscus is formed by a frame that has a larger opening or aperture at one end while a smaller opening or aperture at the other end. The smaller opening in the frame is used to create the active meniscus while the larger opening in the frame is used to create the buffering meniscus. As a result, the buffering meniscus facilitates the maintenance of the tight tolerance required for the actuation gap between the active meniscus of the droplet and the signal electrode. This length of the actuation gap is also maintained over many cycles of switching, thus giving repeatable control over operation of the device.

By using the spreading of the droplet contact line rather than the movement of the entire body of the droplet, a switching can be completed fast. In addition, the small operation distance permits very high switching frequencies. For example, as explained herein, switching latencies of around 50 μs may be obtained with the microswitch described herein which is some 20× faster than other liquid metal droplet switches. See e.g., W. Shen et al., Electrostatically Actuated Metal-Droplet Microswitches Integrated on CMOS Chip, J. MEMS, Vol. 14, No. 4, August 2006, pp. 879-889 (switching latency on the order of 1 millisecond). Moreover, the microswitch described herein is rugged and provides a high degree of stability against shock and vibrations (~16 G).

In one embodiment, a micro droplet switch includes a substrate having an upper surface containing a contact electrode and a separate signal electrode. For example, the contact electrode may comprise an input electrode while the signal electrode may comprise an output electrode. In one aspect the contact electrode may include one of a plurality of signal electrodes. For example, the switch may be closed by the droplet contacting two signal electrodes, one of which is the contact electrode. As explained below, the switch is closed when the droplet electrically connects the contact electrode to the signal electrode. In one aspect of the invention, the droplet may always be in contact with the contact electrode and is selectively engaged with the signal electrode. The micro droplet switch includes at least one actuation electrode disposed beneath the upper surface of the substrate. The at least one actuation electrode is coupled to the drive circuitry for applying a voltage to the actuation electrode. Typically, the at least one actuation electrode is located within or below or layer of dielectric material forming the substrate. The upper surface of the substrate (with the exception of the contact electrode and the signal electrode) may be coated with an insulative, hydrophobic coating such as polytetrafluoroethylene (PTFE). The micro droplet switch includes a frame that is disposed on or above the surface of the substrate and is configured to hold a droplet in substantially the same location during actuation of the switch. In this regard, the frame restricts unwanted free motion of the droplet.

The droplet is a conductive liquid and may be made of a liquid metal such as, for instance, mercury. When placed on the upper surface of the substrate, the interface between the droplet and the surface forms a contact line. This contact line moves in response to actuation of the at least one actuation electrode based on known electrowetting-on-dielectric (EWOD) principles. Generally, in EWOD-based devices, the liquid droplet spreads by modification of the surface tension in response to electrostatic charges induced at the liquid-metal interface of the droplet. When the activation electrode is not activated, the shape of the droplet is restored. While other liquid droplet based devices have relied on EWOD actuation for the bulk movement of droplets, the present micro droplet switch does not rely on the bulk or translational movement of the entire droplet to effectuate switching between a contact electrode and the signal electrode. As explained herein, the use of the frame maintains the droplet in substantially the same location during actuation of the switch.

The frame may be disposed at a predetermined location relative to the signal electrode. In this regard, the switching gap between the contact line of the droplet and the signal drop may be controlled by the design of the frame. The frame may be manufactured using conventional lithographic processes used in the fabrication of semiconductor features. The frame ensures that a substantially constant gap is formed between the contact line of the droplet (in the non-actuated state) and the signal electrode. This gap may be a distance of less than 100 μm or even less than 5-20 μm.

The frame may include multiple openings having different sizes in order to form a buffering meniscus. In this embodiment, the frame includes a first opening that contains or is adjacent to the active meniscus of the droplet. This is the portion of the droplet that undergoes movement to complete the electrical connection between the contact electrode and the signal electrode. The frame also includes a second opening that contains or is adjacent to the non-active meniscus of the droplet. This second opening is larger than the first opening and creates a buffering meniscus. The radius of curvature of the active meniscus is smaller than the radius of curvature of the buffering meniscus which results in the advantageous property that variations in the volume of the droplet are absorbed in the buffering meniscus. To wit, if too much or too little droplet material is deposited on the switch, the buffering meniscus adjusts accordingly, leaving the active meniscus substantially unaffected.

The switch may have multiple signal electrodes which may permit the switch to carry higher currents. In addition, in yet another alternative aspect of the invention, the switch may include one or more heating elements, which may be disposed beneath the upper surface of the substrate. The one or more heating elements may be configured to heat the substrate to remove charges that may have developed in the dielectric layer. The same or additional heating elements may also be used to heat the device during operation so that some metals that are not in a liquid state at room temperature (e.g., gallium) can be used. The heating elements may operate by resistive heating.

In another aspect of the invention, the signal electrode may include a plurality of resistive elements, wherein each resistive element is selectively engaged by the moving contact line during switch actuation. In this regard, the micro droplet switch may be made to have a stepped increase (or decrease) of resistance to reduce arcing when switching inductive loads. This aspect has particular applications when the micro droplet switch is used in "hot switching" inductive loads in RF switching applications.

The micro droplet switch described herein advantageously has fast switching times, for example, an "on latency" of less than about 50 μs. In addition, the switch has a rapid rise/fall time, for instance, less than about 5 μs. Further, these micro droplet switches do not suffer from signal bounce effects that may be found in other MEMS switches (e.g., beam switches). Finally, the use of the constraining frame structure makes these micro droplet switches particularly rugged and durable. For example, the micro droplet switches may exhibit vibrational stability of about to ~16 G.

In another embodiment of the invention, a switch is provided that includes two droplets contained within two frames. In this design the substrate is configured as a coplanar waveguide having a first ground portion, a signal portion, and a second ground portion (GSG design) in which the first and second ground portions include respective ground electrodes. The signal portion is operatively coupled to first and second signal electrodes. A first actuation electrode is disposed beneath the upper surface of the substrate adjacent to the first ground portion (e.g., the actuation electrode may be disposed beneath the upper surface of the substrate and in between the first ground electrode and the first signal electrode), the first actuation electrode being operatively coupled to drive circuitry. A second actuation electrode is disposed beneath the upper surface of the substrate adjacent to the second ground portion (e.g. the second actuation electrode may be disposed beneath the upper surface of the substrate and in between the second ground electrode and the second signal electrode), the second actuation electrode also being operatively coupled to drive circuitry. A first frame is disposed on or above an upper surface of the substrate and configured to hold a first droplet in substantially the same location over the first ground portion. A second frame is disposed on or above an upper surface of the substrate and configured to hold a first droplet in substantially the same location over the second ground portion. Actuation of the first and second actuation electrodes electrically connects the first droplet with the first signal electrode and electrically connects the second droplet with the second signal electrode. This two-droplet embodiment is advantageous because it eliminates signal leakage problems that appear in a single-droplet design for RF applications. This configuration is a shunt switch for RF applications.

In one aspect of the embodiment described immediately above, the first and second frames may have different sized openings to create the active meniscus and the buffering meniscus as described herein. For instance, the openings or apertures in the frame portions that define or are adjacent to the active meniscuses of the droplets are smaller than the openings or apertures in the frame portions that define or are adjacent to the buffering meniscuses of the droplets.

In still another aspect of the invention, a method of switching includes providing a micro droplet switch that includes a substrate having an upper surface containing a contact electrode and a separate signal electrode. The micro droplet switch includes at least one actuation electrode disposed beneath the upper surface of the substrate and operatively coupled to drive circuitry for applying a voltage. The micro droplet switch further includes a frame disposed on or above the upper surface of the substrate that is configured to hold a droplet, the droplet being in electrical contact with the contact electrode. The at least one actuation electrode is activated by applying a voltage to move a contact line of the droplet formed with the substrate surface in electrical contact with the signal electrode, wherein the droplet remains in substantially the same location during actuation of switch.

BRIEF DESCRIPTION OF THE DRAWINGS

FIG. 1A illustrates the microswitch in an "off" state.

FIG. 1B illustrates the microswitch in an "on" state.

FIG. 2A illustrates the microswitch in an "off" state.

FIG. 2A illustrates the microswitch in an "on" state.

FIG. 4B illustrates a three-dimensional perspective view of the micro droplet switch of FIG. 4A.

FIG. 4C illustrates a magnified view of the signal electrode from a portion of the micro droplet switch of FIG. 4B.

FIG. 4D illustrates a three-dimensional perspective view of the micro droplet switch of FIG. 4A containing two liquid droplets.

FIG. 9B illustrates a rise/fall time of less than 5 μs with no bounce in signal.

DETAILED DESCRIPTION OF THE ILLUSTRATED EMBODIMENTS

Figure 1A:
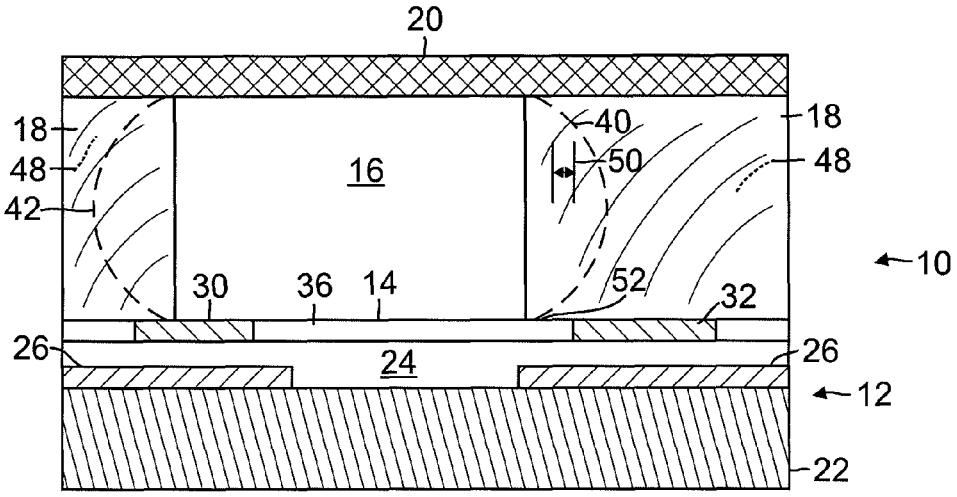
FIG. 1A is a cross-sectional view of a micro droplet switch according to one embodiment.
Figure 1B:
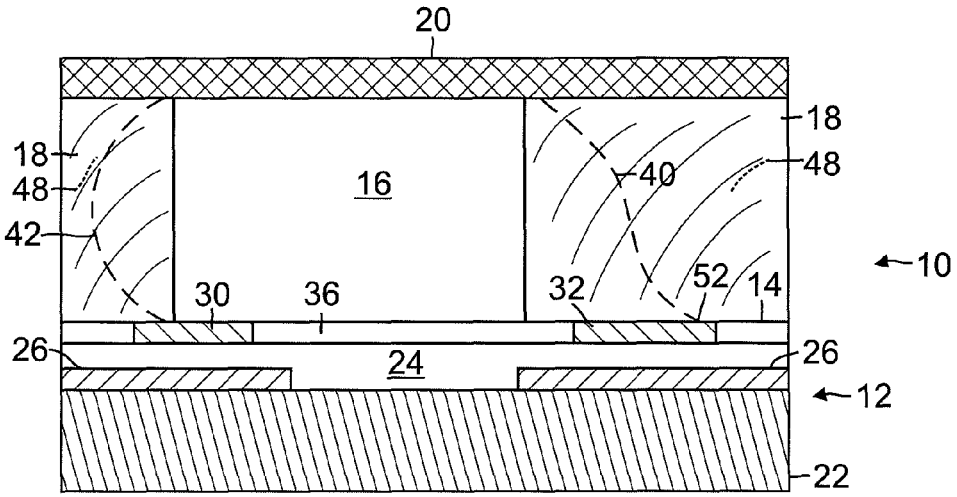
FIG. 1B is a cross-sectional view of a micro droplet switch according to one embodiment.

FIGS. 1A and 1B illustrate a cross-sectional view of a micro droplet switch 10 according to one embodiment. In FIG. 1A, the micro droplet switch 10 is in an "off" state while FIG. 1B illustrates the micro droplet switch 10 in an "on" state. The micro droplet switch 10 includes a substrate 12 having an upper surface 14 on which a liquid droplet 16 rests. The micro droplet switch 10 further contains a frame 18 that disposed on or over the upper surface 14 of the substrate 12. As explained herein, the frame 18 maintains the liquid droplet 16 in substantially the same location during actuation of the micro droplet switch 10. A cap 20 is also illustrated in FIG. 1A which is secured to the upper portion of the frame 18. The micro droplet switch 10 may include one or more additional side walls or the like (not shown) that are located external to the frame to further contain the liquid droplet 16 in a closed environment.

In one embodiment, the substrate 12 is a multilayer substrate that includes a base layer 22 that may be formed from, for example, silicon or glass. A dielectric layer 24 is formed above the base layer 22 and includes one or more actuation electrodes 26. The dielectric layer 24 may include a dielectric material such as $SiO_2$ or $Si_3N_4$. The one or more actuation electrodes 26 may be formed from electrical conductive materials such as metals. For example, the one or more actuation electrodes 26 may be formed from chromium or nickel. The one or more actuation electrodes 26 are operatively coupled to drive circuitry (now shown in FIGS. 1A and 1B) which is configured to apply a driving voltage. The driving voltage is a rapid increase (or decrease) in voltage that is applied to the one or more actuation electrodes 26. The driving voltage is generally below 200V but the invention is not limited to the magnitude of the particular driving voltage.

Still referring to FIGS. 1A and 1B, the upper surface 14 of the substrate 12 includes a contact electrode 30 and a signal electrode 32. The contact electrode 30 and the signal electrode 32 carry the respective signal that is to be switched "on" or "off" by the micro droplet switch 10. For instance, while not shown in FIGS. 1A and 1B, the contact electrode 30 may be electrically coupled to an input while the signal electrode 32 may be electrically coupled to an output. The signal that is modulated by the micro droplet switch 10 may include direct current, alternating current, RF power, etc. In one aspect of the invention, the contact electrode 30 may actually be one of a plurality of signal electrodes 32. For example, the switch 10 may be closed when the droplet 16 contacts two signal electrodes 32, one of which is referred to as the contact electrode 32 because the droplet 16 is in constant contact during operation of the switch 10. The contact electrode 30 and the signal electrode 32 may be made from an electrically conductive material such as, for instance, chromium or nickel although other materials are also contemplated to fall within the scope of the invention. Both the contact electrode 30 and the signal electrode 32 include at least a portion thereof that is exposed to the interior of the micro droplet switch 10. In this regard, the liquid droplet 16 makes electrical contact with the respective contact electrode 30 and signal electrode 32 when contact is made.

The upper surface 14 (except for the contact electrode 30 and signal electrode 32) may be coated with a hydrophobic coating 36 such as polytetrafluoroethylene (PTFE). The coating 36 reduces friction between the liquid droplet 16 and the upper surface 14 of the substrate 20. In another aspect of the invention, the upper surface 14 of the substrate 12 may be optionally patterned to reduce the surface tension formed between the liquid droplet 16 and the upper surface 14 which may aid in increasing the switching speed of the micro droplet switch 10.

The micro droplet switch 10 includes frame 18 that is disposed on or above the upper surface 14 of the substrate 12. In this aspect, the frame 18 is formed on or is otherwise built up or bonded to the substrate 12. However, it is also possible that the frame 18 is formed as part of or is connected to the upper cap 20 of the micro droplet switch 10. The frame 18 may be made of a number of materials typically used in semiconductor or microfluidic applications such as, for instance, photoresist such as SU-8. As explained herein, the frame 18 is used to restrict free movement of the liquid droplet 16 on the upper surface 14 of the substrate 12. The frame 18 may include a plurality of walls or posts that are formed to constrain translational movement of the liquid droplet 16. While the frame 18 is used to constrain displacement or translation of the entire liquid droplet 16, in some embodiments, the frame 18 is used to define both an active meniscus 40 and a non-active meniscus 42.

Figure 2A:
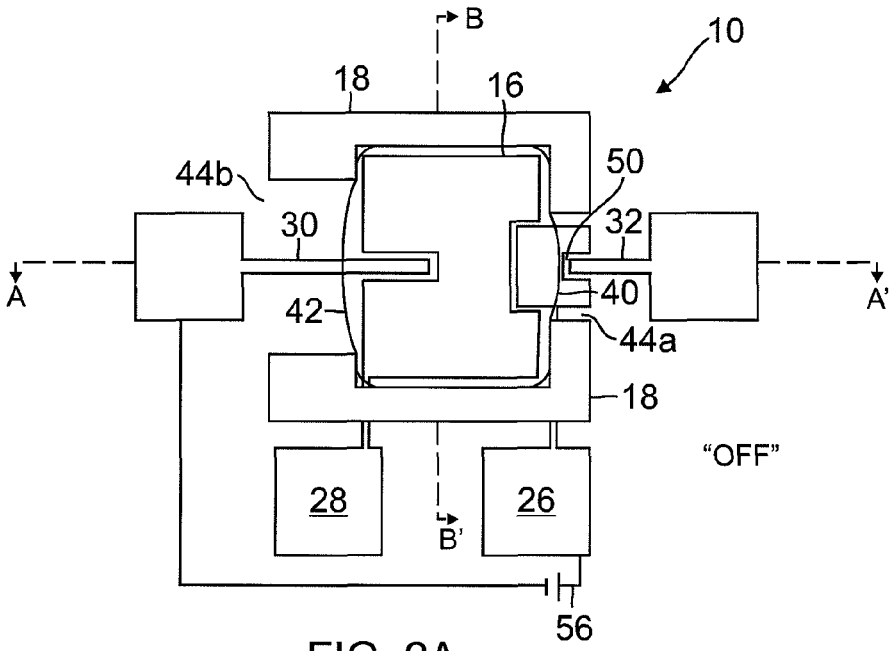
FIG. 2A illustrates a top down plan view of a micro droplet switch according to another embodiment.
Figure 2B:
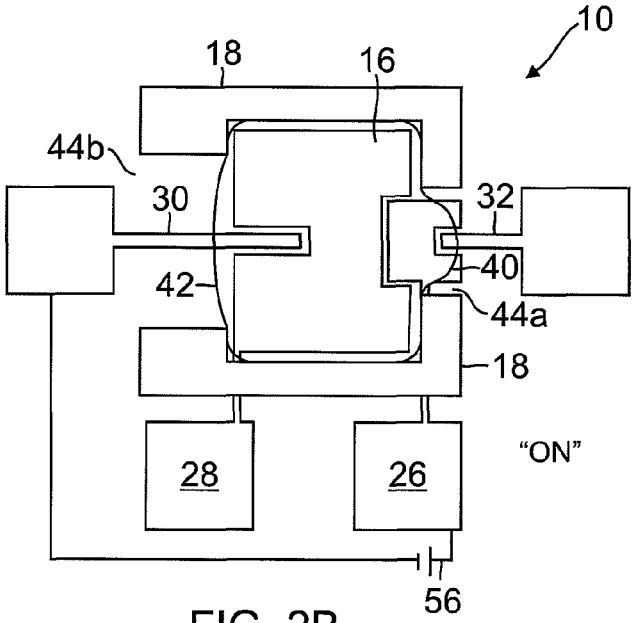
FIG. 2B illustrates a top down plan view of a micro droplet switch according to another embodiment.

The active meniscus 40 is the portion of the meniscus of the liquid droplet 16 that is moved by the actuation electrode(s) 26 to complete the circuit between the contact electrode 30 and the signal electrode 32 upon actuation of the micro droplet switch 10. The non-active meniscus 42 is the portion of the meniscus of the liquid droplet 16 that is not moved by the by the actuation electrode(s) 26 during switch operation. The active meniscus 40 and the non-active meniscus 42 are defined by a number of openings or apertures 44 in the frame 18 (illustrated in FIGS. 2A and 2B). FIGS. 2A and 2B illustrate an aperture 44*a* which forms the active meniscus 40 and aperture 44*b* which forms the non-active meniscus 42. As explained in more detail below, the non-active meniscus 42 may act as a buffering meniscus that compensates for variations in the volume of the liquid droplet 16 that is placed on the micro droplet switch 10.

The liquid droplet 16 is formed from an electrically conductive material such that when the liquid droplet 16 contacts both the contact electrode 30 and the signal electrode 32, the micro droplet switch 10 is closed and signal can pass from the contact electrode 30 through the liquid droplet 16 and into the signal electrode 32 (or vice versa as the case may be). In one aspect of the invention, the liquid droplet 16 includes a liquid metal such as mercury although other metals and alloys may also be used. As seen in the embodiment of FIGS. 1A and 1B, in both the "off" and "on" states, the liquid droplet 16 makes electrical contact with the contact electrode 30. To close the micro droplet switch 10 only the active meniscus 40 needs to be moved a relatively short distance to make electrically contact. The liquid droplet 16 may be surrounded by dielectric fluid 48 that is immiscible with the liquid droplet 16. This fluid 48 may be a liquid or a gas (e.g., oil or air).

As seen in FIG. 1A, in the "off" state, a relatively small actuation gap 50 is formed between the contact line 52 of the liquid droplet 16 and the signal electrode 32. The contact line 52 refers to the peripheral interface between the liquid droplet 16 and the upper surface 14 of the substrate 12. In one aspect of the invention, the actuation gap 50 is less than around 100 μm in length, and in some instances, as small as about 10 μm in length. In addition, the actuation gap 50 preferably is stable in that over many cycles of the micro droplet switch 10 the actuation gap 50 remains substantially constant in the "off" state.

FIG. 1B illustrates the micro droplet switch 10 in the "on" state after an actuating voltage has been applied to the underlying actuation electrode 26 located on the right hand side of FIG. 1B. Actuation of the electrode 26 causes the active meniscus 40 and thus the contact line 52 to move to the right until the liquid droplet 16 comes into physical contact with the signal electrode 32. The switch is turned back to the "off" state by de-energizing the electrode 26. When the electrode 26 is not powered, the liquid droplet will naturally revert back to the state illustrated in FIG. 1A. The switching process can, of course, continue as explained above for any number of additional cycles. The left most actuation electrode 26 is optional and may be used to assist in pulling the liquid droplet 16 back into its resting state. For example, in some micro droplet switches 10 the "off latency" or the amount of time needed to open the switch after de-energizing the actuation electrode 26 (right hand side one in FIGS. 1A and 1B) is longer than the "on latency" or the amount of time needed to close the switch after energizing the actuation electrode 26. In order to reduce the "off latency" time, an actuation electrode 26 may be activated to assist the liquid droplet 16 to return back to the resting state illustrated in FIG. 1A.

FIGS. 2A and 2B illustrate another embodiment of a micro droplet switch 10. FIG. 2A illustrates the micro droplet switch 10 in an "off" state while FIG. 2B illustrates the micro droplet switch 10 in an "on" state. As seen in FIGS. 2A and 2B, the frame 18 is formed with two different sized openings 44*a*, 44*b*. The smaller of the two openings 44*a* forms the active meniscus 40 while the larger aperture 44*b* located on the opposing side of the frame 18 forms the non-active meniscus 42 which acts as a buffering meniscus. As seen in FIGS. 2A and 2B, the liquid droplet 16 is constrained within the frame 18 thereby preventing free movement of the liquid droplet during activation of the micro droplet switch 10.

Referring now to FIG. 2A, an actuation gap 50 is formed between the active meniscus 40 (or contact line 52) and the signal electrode 32. This actuation gap 50 is substantially constant when the micro droplet switch 10 is in the "off" state as illustrated in FIG. 2A. The substantially constant actuation gap 50 is also maintained by the use of the buffering meniscus 42. The radius of curvature of the active meniscus 40 is smaller than the radius of curvature at the buffering meniscus 42. The buffering meniscus 42 has the advantageous property that it can adjust for changes in volumes of the liquid droplet 16 that is applied to the micro droplet switch 10. For example, if too much or too little droplet material is deposited, the excess or shortage of material will be accommodated by changes in the buffering meniscus 42 which will not affect the active meniscus 40. In this regard, even if too much (or too little) material for the liquid droplet 16 is deposited, the actuation gap 50 remains constant. This is significant because with prior switch designs it was difficult to accurately deposit the correct amount of droplet material in the switch. Also, as seen in FIGS. 2A and 2B, accurate positioning of the liquid droplet 16 is achieved by the constrained configuration that holds the liquid droplet 16 in the proper location relative to the contact electrode 30 and signal electrode 32.

FIGS. 2A & 2B also illustrate a second optional actuation electrode 28 that, as explained above, may be used to reduce the off latency of the micro droplet switch 10. The second actuation electrode 28 may be activated after the main actuation electrode 26 has been de-energized so that the liquid droplet 16 can more rapidly return to the state illustrated in FIG. 2B. Of course, the second actuation electrode 28 is optional and may be omitted entirely. FIGS. 2A and 2B also illustrate the drive circuitry 56 that is used to apply a driving voltage to the actuation electrode 26. In some instances the actuation voltage applied by the drive circuitry 56 may be a positive voltage while in other instances it may be a negative voltage.

Figure 3A:
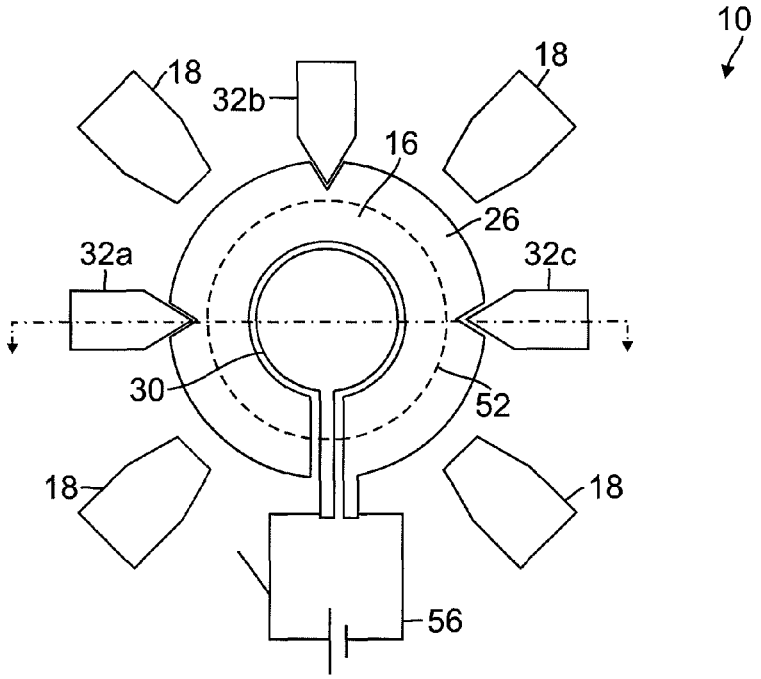
FIG. 3A illustrates a top down plan view of a micro droplet switch according to another embodiment. Drive circuitry is also illustrated.
Figure 3B:
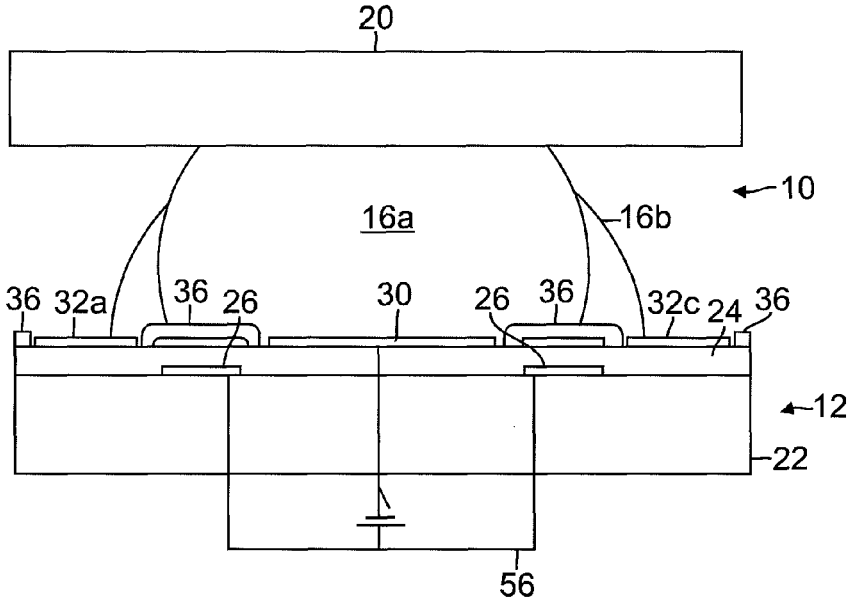
FIG. 3B illustrates a side view of the micro droplet switch of FIG. 3A with the frames omitted for clarity purposes.
Figure 3C:
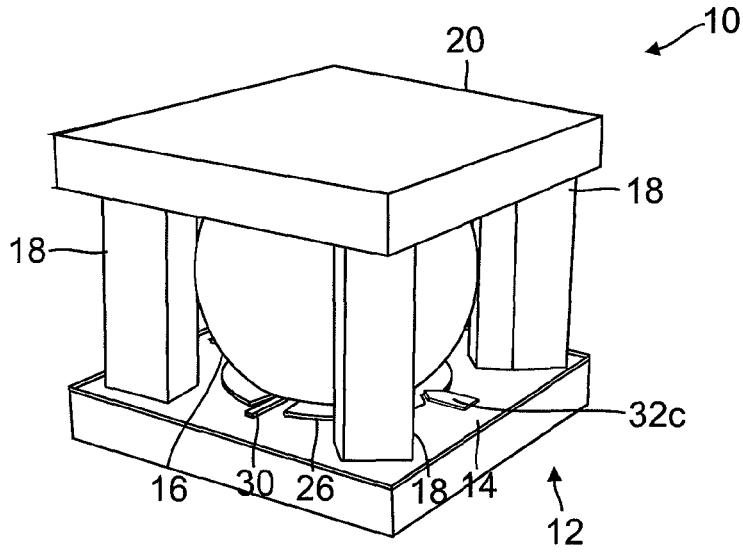
FIG. 3C illustrates a three-dimensional perspective view of the micro droplet switch of FIGS. 3A and 3B with a droplet contained within the switch.

FIGS. 3A, 3B, and 3C illustrate another embodiment of a micro droplet switch 10. Referring to FIG. 3A, which illustrates a top-down plan view, the micro droplet switch 10 includes four posts or pillar structures that makeup the frame 18. The frame 18 in this embodiment is substantially symmetrical and there are no different sized openings although in other alternative embodiments the frame 18 may utilize different sized openings as described above to take advantage of the buffering meniscus. Still referring to FIG. 3A, the micro droplet switch 10 includes three signal electrodes 32*a*, 32*b*, 32*c* positioned about the periphery of the switch 10. Multiple signal electrodes 32*a*, 32*b*, 32*c* may be particularly useful for switching relatively large currents. In addition, as seen in FIG. 3A, the three signal electrodes 32*a*, 32*b*, 32*c* terminate in a pointed tip. In this embodiment, the actuation electrode 26 is made from a circular electrode that is disposed inside the dielectric layer 24 (e.g., $Si_3N_4$) disposed above base layer 22. The contact electrode 30 in this embodiment is disposed on the upper surface 14 of the substrate 12 in a circular shape and acts as a ground electrode. In some instances, the ground electrode 30 may be disposed beneath the upper surface 14 of the substrate 12. As seen in FIGS. 3A and 3B, the drive circuitry 56 couples the actuation electrode 26 with the contact electrode 30.

FIG. 3B illustrates a cross-sectional view of the micro droplet switch of FIG. 3A taken along the line A-A' (with frames removed for clarity purposes). A first liquid droplet 16*a* is illustrated in the quiescent or "off" state while a second liquid droplet 16*b* is illustrated in the "on" state. As seen in FIG. 3B, in the "off" state the liquid droplet 16*a* only contacts the contact electrode 30 (e.g., ground electrode). This can be seen by the contact line 52 which does not touch any of the signal electrodes 32*a*, 32*b*, 32*c*. However, when the underlying actuation electrode 26 is activated, the contact line 52 of the liquid droplet 16 expands outward until the liquid droplet 16*b* makes electrical contact with the signal electrodes 32. Preferably, the configuration of the multiple signal electrodes 32*a*, 32*b*, 32*c* is such that contact is made at substantially the same time. As also seen in FIG. 3B, with the exception of the contact electrode 30 and the signal electrodes 32*a*, 32*b*, 32*c*, the upper surface 14 of the substrate 12 contains a coating 36 of PTFE or the like. FIG. 3C illustrates a three dimensional image of the micro droplet switch 10 of FIGS. 3A and 3B.

In the micro droplet switch 10 of FIGS. 3A-3C, the high surface tension of the liquid droplet 16 ensures that the same is accurate positioned and enables small actuation gaps 50. For a given volume of droplet fluid, any variation in the base radius (contact line 52 position) due to hysteresis is accompanied by a change in the spherical radius of the liquid droplet 16. However, the frame 18 restricts the change in the spherical radius of the liquid droplet 16. Thus, any variation in the contact line 52 position due to hysteresis can only be possible through a variation in the local curvature. The variation in the local curvature gives rise to a restoring Laplace pressure which resists the change in the position of the contact line 52.

The above-described micro droplet switch 10 is able to be implemented in so-called "hot switch" applications where the signal between the contact electrode 30 and the signal electrode 32 remains on during the switching application. This is particularly advantageous for RF applications. The micro droplet switch 10 also exhibits excellent durability and stability. Because the liquid droplet 16 is securely contained within the micro droplet switch 10 via the frames 18, vibration stability up to about 16 G is possible. Of course, other switch designs can exhibit even better stability.

Figure 4A:
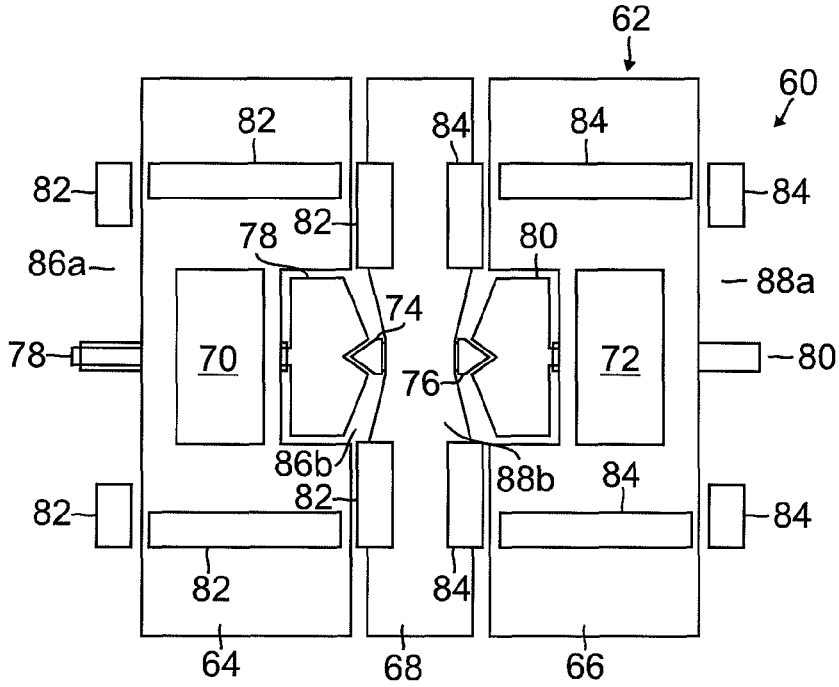
FIG. 4A illustrates a top down plan view of a micro droplet switch according to another embodiment. This embodiment uses two droplets located on a coplanar waveguide.

FIGS. 4A, 4B, and 4C illustrate another embodiment of a micro droplet switch 60 that includes first and second droplets 61*a*, 61*b*. In this embodiment, a substrate 62 is configured as a coplanar waveguide having a first ground portion 64, a second ground portion 66, and a signal portion 68 interposed between the first and second ground portions 64, 66. The coplanar waveguide thus configured as a standard GSG coplanar waveguide. The first ground portion 64 includes a ground electrode 70 disposed on a surface thereof In a similar manner, the second ground portion 66 includes a ground electrode 72 disposed on a surface thereof The ground electrodes 70, 72 are disposed in such a manner that a liquid droplets 61*a*, 61*b* are always in electrical contact with their respective ground electrodes 70, 72. The signal portion 68 of the coplanar waveguide substrate 62 is operatively coupled to a first signal electrode 74 and a second signal electrode 76. As best seen in FIG. 4A, a first actuation electrode 78 is located beneath the upper surface 63 adjacent to the first ground portion 64. A recessed portion may optionally be formed in the first ground portion 64 in which the actuation electrode 78 is disposed. The actuation electrode 78 is operatively coupled to driving circuitry (not shown) configured to apply a driving voltage. A second actuation electrode 80 is located beneath the upper surface 63 adjacent to the second ground portion 66 and is also operatively coupled to driving circuitry (not shown) configured to apply a driving voltage. The second actuation electrode 80 may optionally be disposed in a recessed portion formed in the second ground portion 66.

As best seen in FIGS. 4A and 4B, the micro droplet switch 60 includes two separate frames 82, 84 for holding the respective droplets 61*a*, 61*b*. The frames 82, 84 form two separate enclosures for the droplets 61*a*, 61*b*. The frames 82, 84 may be formed as a series of walls patterned from a photoresist such as SU-8. In this embodiment, frame 82 includes two opposing openings 86*a*, 86*b* having different sizes so that an active meniscus and a buffering meniscus can be formed in the liquid droplet 61*a* as described herein. Similarly, frame 84 includes two opposing openings 88*a*, 88*b* having different sizes.

FIG. 4C illustrates a magnified view of one of the signal electrodes 74 electrically coupled to the signal portion 38 of the substrate 62. The signal electrode 74 includes a sharpened tip although other configurations may be employed in the micro droplet switch 60. The opposing signal electrode 76 (not magnified in FIG. 4C) is configured in a similar manner.

The micro droplet switch 60 of FIGS. 4A-4C is particularly useful as a shunt switch although the particular implementation of the switch 60 is not limited to shunt switches. In a shunt switch, the switch is open until the signal electrode is electrically coupled to the ground electrode. In the micro droplet switch 60 described above, the switch is opened by activation of the two actuation electrodes 78, 80 at substantially the same time. When the actuation electrodes 78, 80 are driven with an actuating voltage, the active portions of the droplets 61*a*, 61*b* are drawn toward the signal portion 68 of the switch 60 until the droplets 61*a*, 61*b* make contact with their respective signal electrodes 74, 76. When the droplets 61*a*, 61*b* connect the ground electrodes 70, 72 with their respective signal electrodes 74, 76 the switch is open because the signal portion 68 is at the same potential as the ground electrodes 70, 72. By using the two droplet configuration, this design solves capacitance leak that would otherwise occur from leakage of charges from the signal line to the ground line via the actuation electrode. In the micro droplet switch 10 of FIGS. 4A-4C overall capacitive leakage during the "off" state is reduced. The micro droplet switch 10 has been modeled using commercially available finite element analysis software (High Frequency Structure Simulator—HFSS) which simulated a better than 0.2 dB insertion loss up to 40 GHz of operation.

Figure 5A:
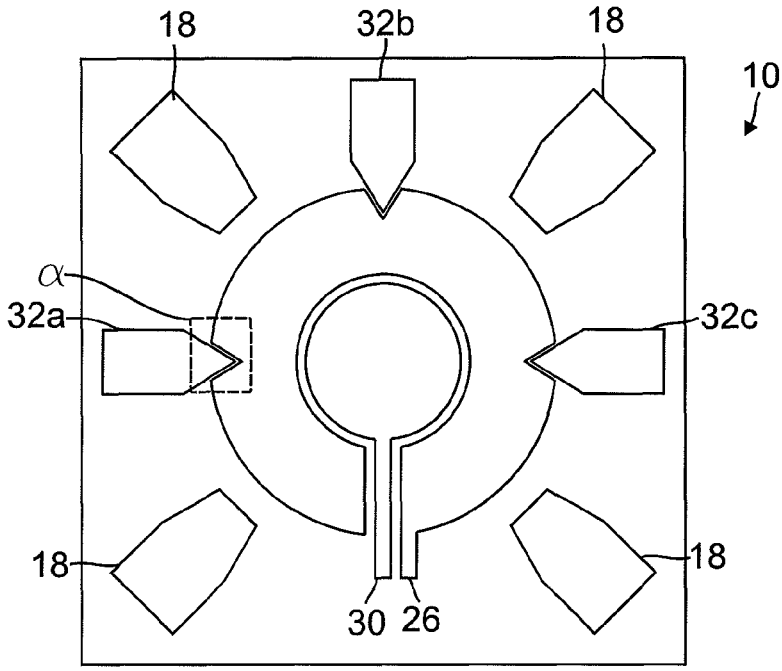
FIG. 5A illustrates a top down plan view of a micro droplet switch according to another embodiment.
Figure 5B:
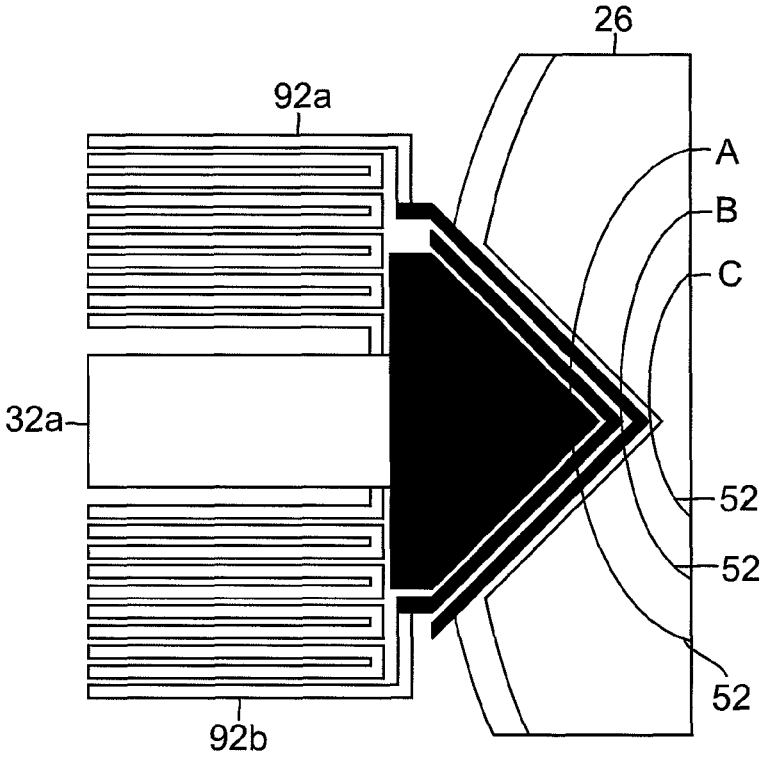
FIG. 5B illustrates a magnified view of the dashed region α illustrated in FIG. 5A showing the plurality of resistive elements.

FIGS. 5A and 5B illustrate another alternative aspect of the invention. In this embodiment, a plurality of resistive elements 92*a*, 92*b* are coupled to the signal electrode 32. The plurality of resistive elements 92*a*, 92*b* provide a stepped increase (or decrease in other cases) in the resistance of the signal path between the contact electrode 30 and the signal electrode 32. This embodiment may be particularly useful in high power switching applications where arcing is a concern. By progressively stepping the resistance to a higher level during switch deactivation (or activation), the potential to cause arcing is reduced. While FIG. 5B illustrates two restive elements 92*a*, 92*b*, in other embodiments there could be a single resistive element 92 or more than two.

FIG. 5A illustrates a switch 10 of the type illustrated in FIGS. 3A and 3B although the resistive elements 92*a*, 92*b* may be used in other embodiments described herein. FIG. 5A illustrates a dashed region that encompasses the interface of a signal electrode 32*a* and an upper surface 14 of the switch substrate 12. FIG. 5B also illustrates movement of the contact line 52 formed by a droplet as the switch 10 is deactivated (i.e., opened). Thus, in FIG. 5B the droplet initially has a contact line illustrated by A, then moves to position B, and then to position C, and then finally is out of contact with the signal electrode 32*a*.

Figure 6A:
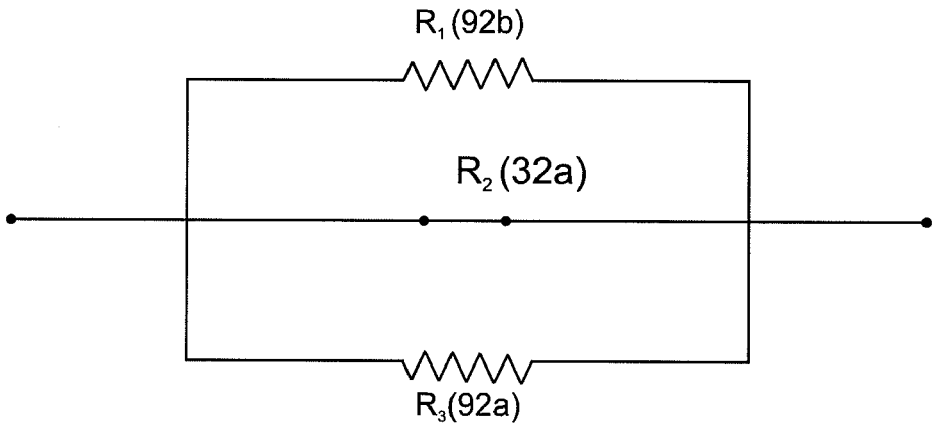
FIG. 6A illustrates a schematic representation of the electrical contact made between the liquid droplet and the signal electrode when the droplet contact line is located at position "A" in FIG. 5B.

As seen in FIG. 5B, the resistive elements 92*a*, 92*b* comprise a resistive path that couples to the signal electrode 32*a*. The resistive element 92*a*, 92*b* may be patterned on an upper surface 14 of the substrate 12 using conventional semiconductor processes. In one embodiment, the resistance is stepped up in an increasing fashion as the switch is turned off by de-energizing the actuation electrode 26. For example, with reference to FIG. 5B, the contact line 52 identified as "A" indicates a state wherein the liquid droplet 16 contacts both resistive elements 92*a*, 92*b*, as well as the signal electrode 32*a*. The electrical schematic of this configuration is illustrated in FIG. 6A. In this configuration, the switch is in the fully "on" state.

Figure 6B:
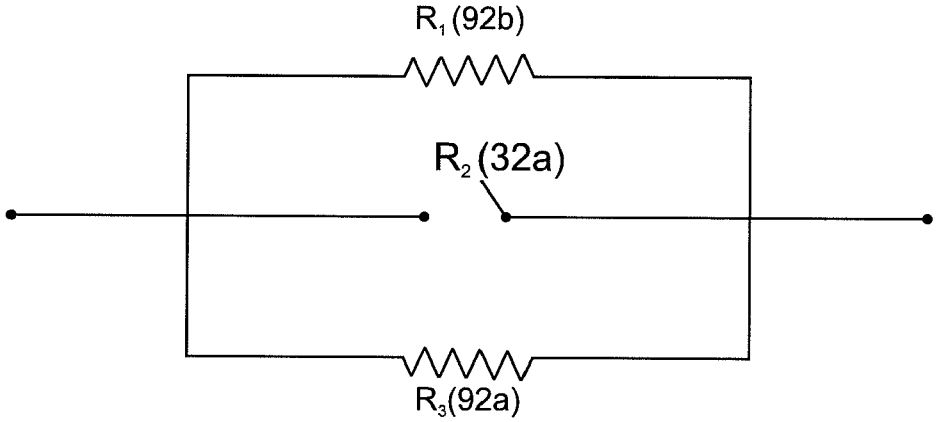
FIG. 6B illustrates a schematic representation of the electrical contact made between the liquid droplet and the signal electrode when the droplet contact line is located at position "B" in FIG. 5B.
Figure 6C:
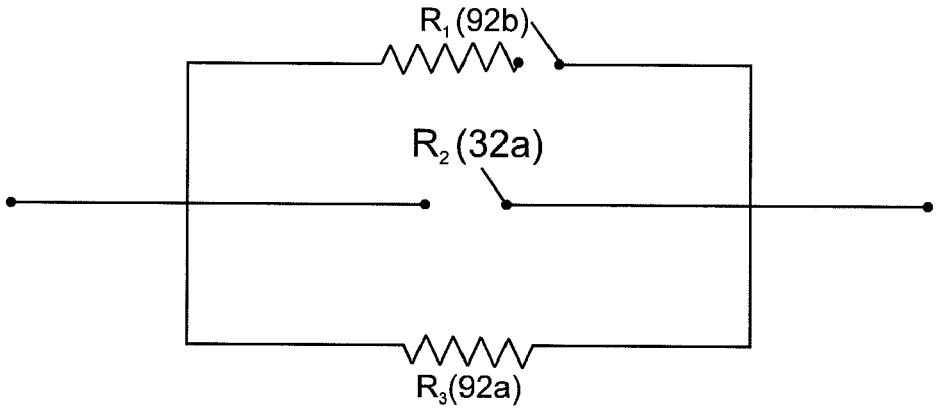
FIG. 6C illustrates a schematic representation of the electrical contact made between the liquid droplet and the signal electrode when the droplet contact line is located at position "C" in FIG. 5B.

When the micro droplet switch 10 is turned off, the liquid droplet 16 begins to restore to its original configuration. The contact line 52 identified in FIG. 5B as "B" illustrates movement of the droplet away from the contact electrode 32A. Electrically contact is still made to the signal electrode 32*a* but at an increased resistance because of the two resistive elements 92*a*, 92*b*. The electrical schematic of this configuration is illustrated in FIG. 6B. R2 is open and current passes through R1 and R3. The liquid droplet 16 continues to move back to its original configuration. The contact line 52 identified in FIG. 5B as "C" illustrates additional movement of the droplet away from the contact electrode 32A. Electrically contact is made to the signal electrode 32*a* at an increasing resistance by passing through resistive element 92*a* (but not resistive element 92*b*). The electrical schematic of this configuration is illustrated in FIG. 6C. R1 and R2 are open and current passes only through R3. Eventually, the liquid droplet 16 is electrically disconnected from the signal electrode 32*a* completely.

Figure 7:
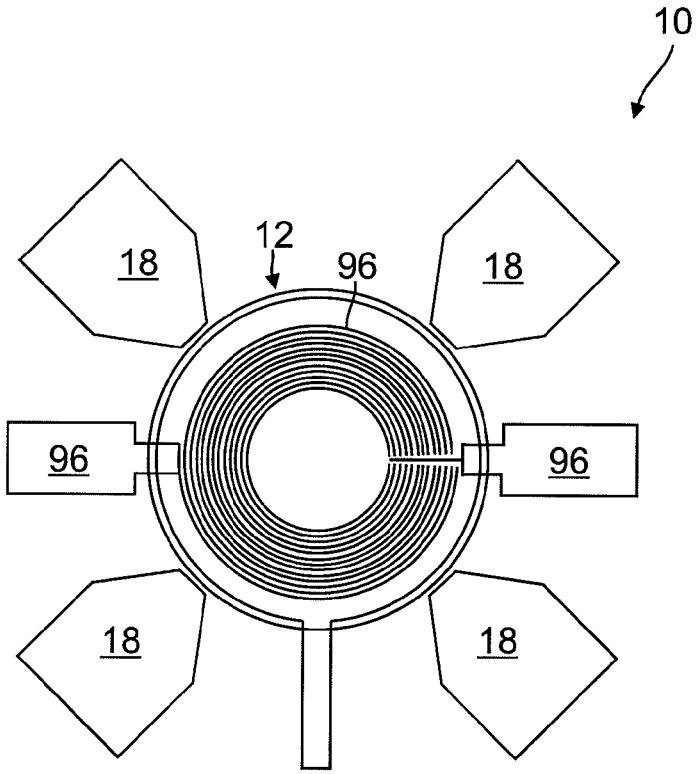
FIG. 7 illustrates a top down plan view of a micro droplet switch according to another embodiment. In this embodiment, a heater element is disposed under the upper surface of substrate that is configured to heat the dielectric layer.

FIG. 7 illustrates another embodiment of a micro droplet switch 10. In this embodiment, a heating element 96 is located underneath the upper surface 14 of the substrate 12. For example, the heating element 96 (or multiple heating elements) may be placed between the dielectric layer 24 and the coating layer 36 (e.g., PTFE). The heating element 96 may be formed as a resistive heating element that emits heat upon the application of electrical current. The heating element 96 is used to discharge the dielectric layer 24 of charges. This may lead to longer switch life. While FIG. 7 illustrates the heating element 96 in a micro droplet switch 10 of the type illustrated in FIGS. 3A and 3B, the heating element 96 may be incorporated into other switch embodiments described herein.

Figure 8:
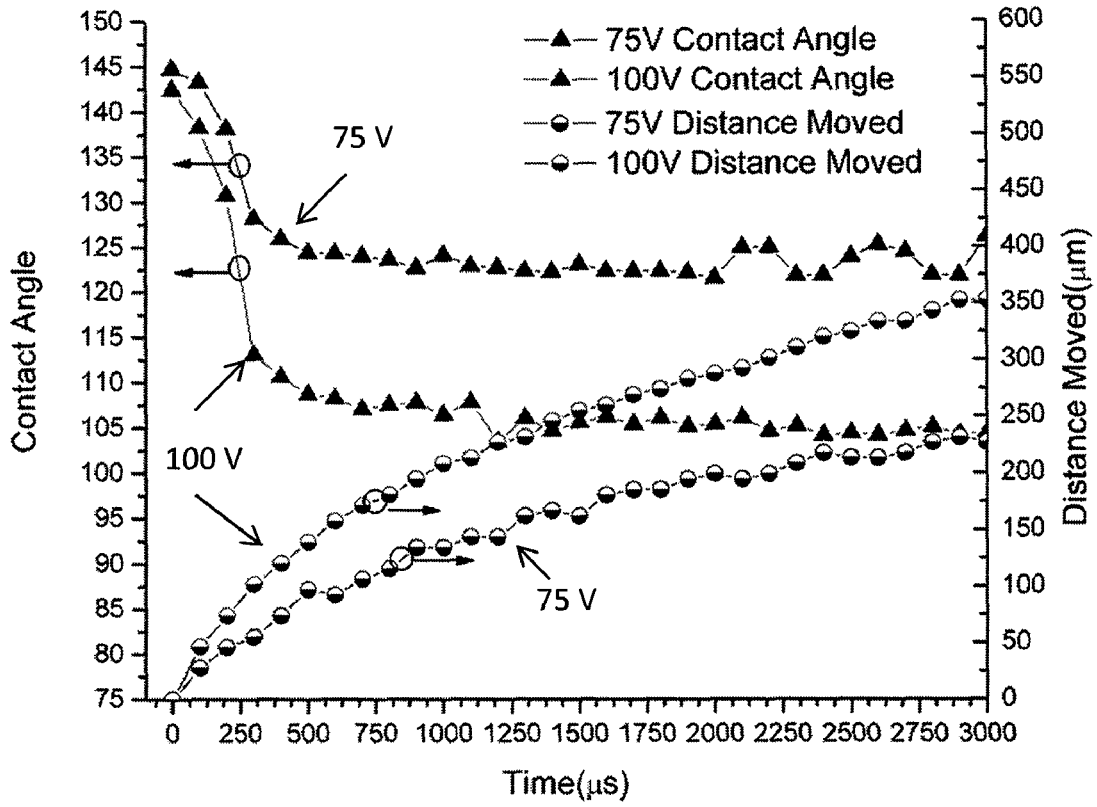
FIG. 8 is a graph of the contact angle and distance moved as a function of time for two different actuation voltages (75V and 100V).

The fast switching times of the micro droplet switches 10, 60 described herein is produced not only by the small actuation gap 50 but also the speed of the active meniscus 40. FIG. 8 illustrates a graph of contact angle and distance moved (active meniscus) for different actuation voltages (75V and 100V). As seen in the data for the distance moved, the speed is very rapid during the time when the contact angle is changing just after actuation and begins to level or taper off as time progresses. The above-described micro droplet switches 10, 60 utilize the initial high speeds (e.g., ~40-50 cm/s) that are generated just after actuation to close the actuation gap 50.

Figure 9A:
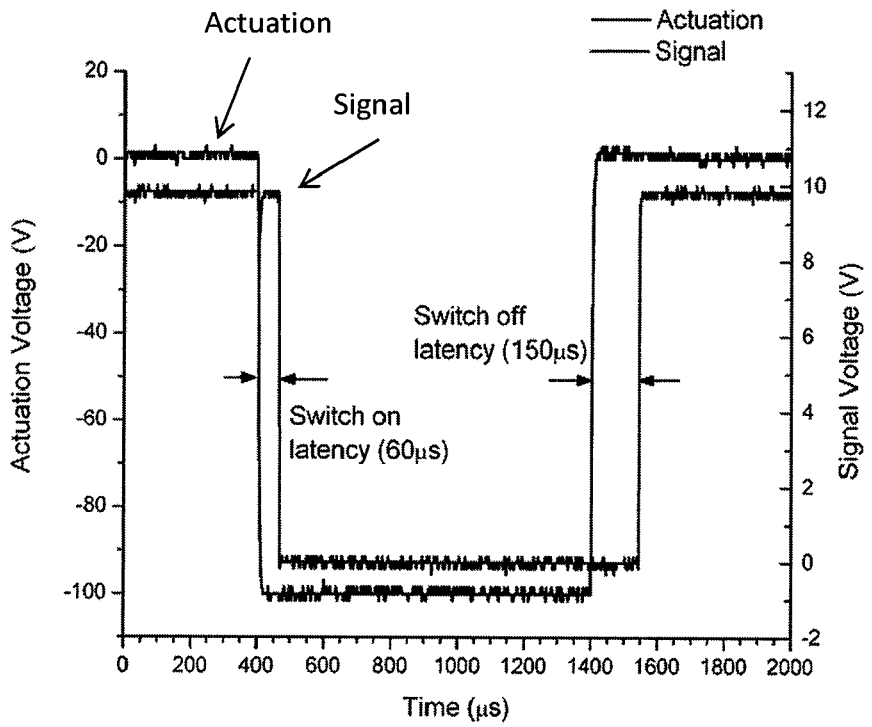
FIG. 9A is a graph of the actuation voltage (V) and signal voltage (V) as a function of time for a micro droplet switch. The on latency is around 60 μs and the off latency is around 150 μs.
Figure 9B:
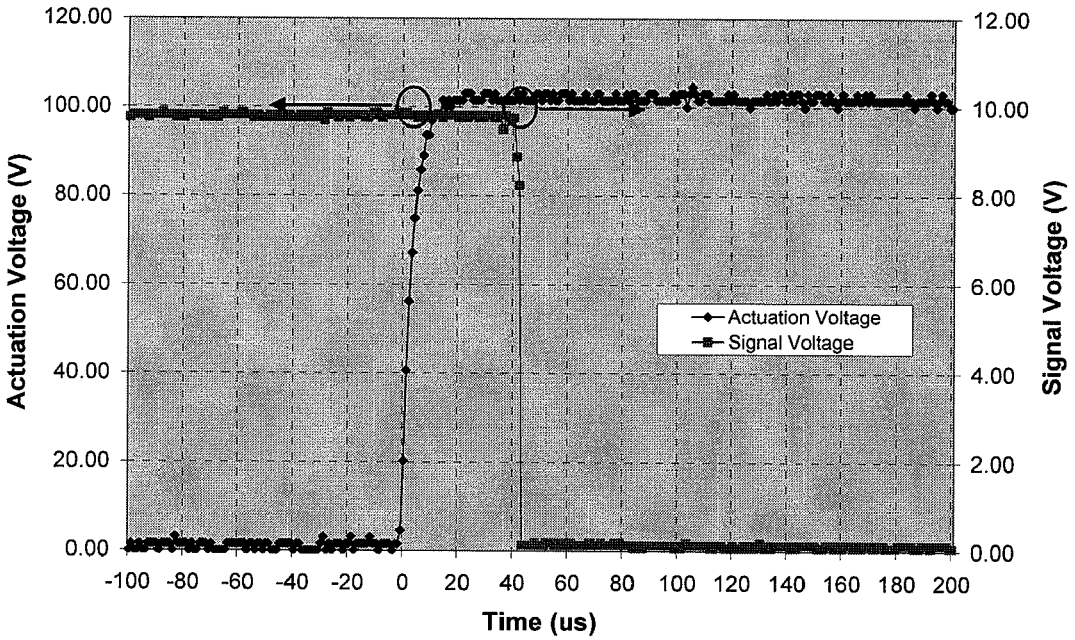
FIG. 9B is another graph of the actuation voltage (V) and signal voltage (V) as a function of time for a micro droplet switch.

FIGS. 9A and 9B illustrate the performance characteristics of the micro droplet switch 10 after actuation of the actuation electrode 26. FIG. 9A illustrates an "on latency" of around 60 μs after electrode 26 actuation. It should be noted, however, that on latency values of less than about 50 μs have been obtained using micro droplet switch configurations described herein. This is approximately 20× faster than the switching times reported by others. FIG. 9A also illustrates that there is no signal bounce after the micro droplet switch 10 has been closed. FIG. 9A also illustrates the "off latency" of the micro droplet switch 10 after the actuation electrode 26 has been turned off. The off latency is around 150 μs. FIG. 9B illustrates the rise/fall time of the micro droplet switch 10 in response to the application of the actuation voltage (100V). As seen in FIG. 9B, the rise fall time is less than 5 μs with no bounce in signal.

Figure 10:
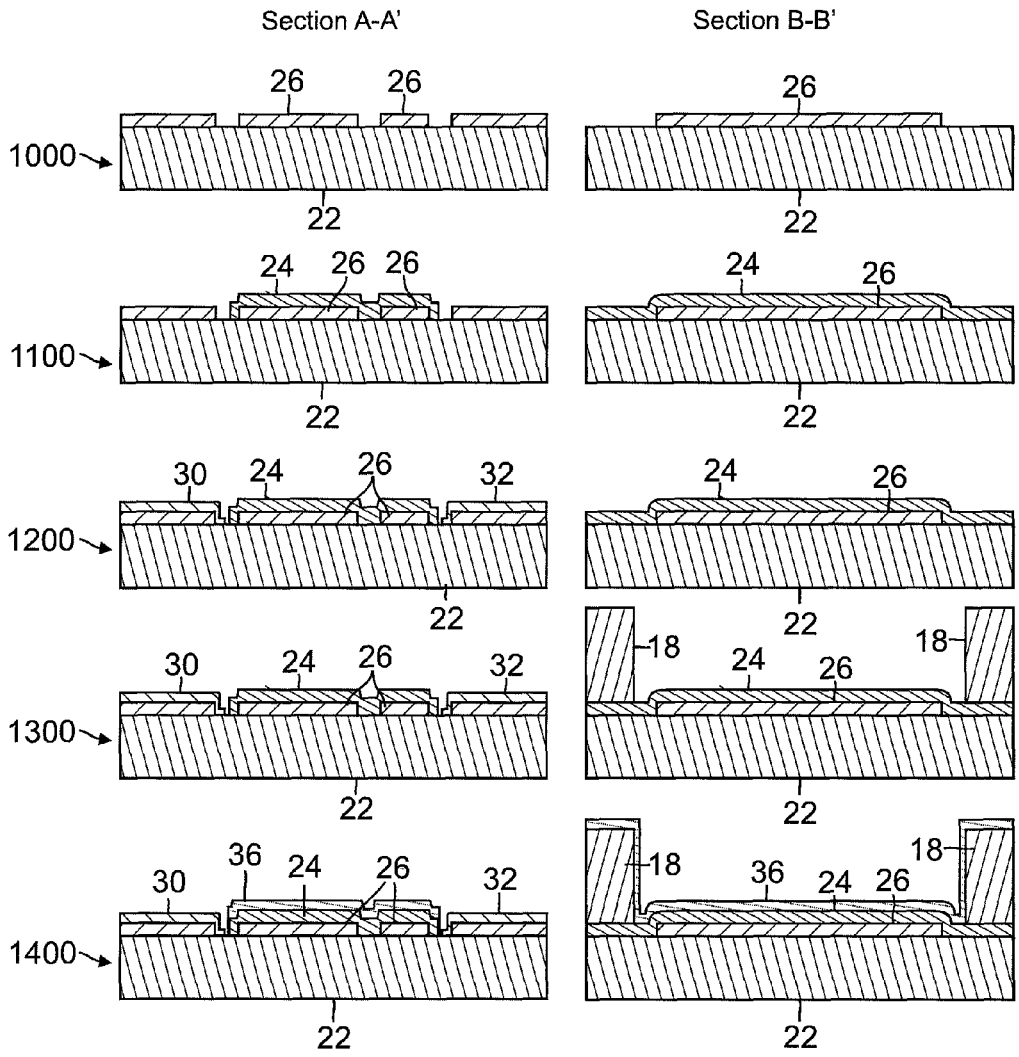
FIG. 10 illustrates an illustrative method of making a micro droplet switch according to one aspect of the invention.

FIG. 10 illustrates a process of fabricating a micro droplet switch 10. Specifically, FIG. 10 illustrates a process of illustrating a micro droplet switch 10 of the type illustrated in FIGS. 2A and 2B although the processes described herein may also be used for other embodiments of the micro droplet switches. The left side of FIG. 10 illustrates the fabrication of the micro droplet switch 10 along the line A-A' in FIG. 2A while the right side of FIG. 10 illustrates the fabrication of the micro droplet switch 10 along the line B-B' in FIG. 2A. Generally, the fabrication process is a multi-step lithography process in which the various features are built on or in the substrate 12. As seen in operation 1000 of FIG. 10, chromium is deposited on a base layer 22 (e.g., glass) using, for example, e-beam deposition. The deposited chromium is then patterned and wet etched in chromium photomask etchant to form the actuation electrodes 26. Next, in operation 1100 a 3500 Angstrom silicon nitride dielectric layer 24 is deposited using PECVD. The dielectric layer 24 is then patterned and etched using reactive ion etching (RIE) to open the contact pads.

As seen in operation 1200, lift-off nickel is used to form the contact electrode 30 and the signal electrode 32. Nickel is used because it is one of the few metals that does not chemically react with mercury, which is used for the liquid droplet 16. Alternatively, chromium may be used but its surface oxidation can lead to excessive contact resistance. Next, in operation 1300, a multi-coat SU-8 process is used to form 500 μm high frames 18. Because a long, continuous exposure required to heat the relatively thick SU-8 layer causes hardening of the resist due to heating, the process is broken up into a series of heating/cooling steps. In particular, the total exposure time was broken into steps of 30 seconds with 30 seconds of cooling between subsequent exposures. In operation 1400 a hydrophobic coating 26 (e.g., PTFE) is then spin coated on the upper surface 14 of the substrate 20. This hydrophobic coating 26 is then patterned and etched using $O_2$ plasma. While not illustrated in FIG. 10, a liquid droplet 16 is then deposited on the micro droplet switch 10. For example, the liquid droplet 16 may include a 600 μm diameter mercury droplet that is placed on the micro droplet switch 10 using a pipette or the like. A cap 20 (not shown in FIG. 10), can then be adhered to the upper surface of the frame 18 to enclose the liquid droplet 16.

The micro droplet switches 10, 60 described herein enable fast mechanical-based switches. These micro droplet switches 10, 60 may be particularly useful in RF switching applications such as base stations, radar devices, or even mobile devices although the invention is not limited to any particular application. The micro droplet switches 10, 60 may also be particularly suited for "hot switching" applications.

While embodiments of the present invention have been shown and described, various modifications may be made without departing from the scope of the present invention. The invention, therefore, should not be limited, except to the following claims, and their equivalents.

What is claimed is:

1. A switch comprising:

a substrate having an upper surface containing at least one signal electrode;

at least one actuation electrode disposed beneath the upper surface of the substrate; the at least one actuation electrode operatively coupled to drive circuitry; and a frame disposed on or above the upper surface of the substrate and configured to hold a droplet in substantially the same location during actuation of the switch, wherein the frame includes a first opening configured to define a first portion of the droplet meniscus and a second opening configured to define a second portion of the droplet meniscus, wherein the second opening is larger than the first opening.

2. The switch according to claim 1, wherein the frame is disposed at a predetermined location relative to the at least one signal electrode.

3. The switch according to claim 1, wherein the droplet comprises a conductive liquid, the droplet being surrounded by a dielectric fluid that is immiscible with the droplet.

4. The switch according to claim 1, wherein when the switch is a non-actuated state, the frame maintains a substantially constant gap between a contact line of the droplet and the at least one signal electrode.

5. The switch according to claim 4, wherein the substantially constant gap is a distance within the range of less than 100 μm.

6. The switch according to claim 4, wherein during actuation, a contact line of the droplet moves initially at a first speed and later at a second speed slower than the first speed and wherein the droplet contacts the at least one signal electrode when moving at the first speed.

7. The switch according to claim 1, wherein the switch has an on latency of less than about 50 μs.

8. The switch according to claim 1, wherein the switch has a rise/fall time of less than about 5 μs.

9. The switch according to claim 1, further comprising a ground electrode disposed on or beneath the upper surface of the substrate, the ground electrode being operatively coupled to drive circuitry.

10. The switch according to claim 1, further comprising a second signal electrode disposed on the upper surface of the substrate.

11. The switch of claim 1, further including a heater configured to heat the switch.

12. The switch of claim 11, wherein the heater comprises at least one heating element disposed beneath the upper surface of the substrate, the at least one heating element being configured to heat a dielectric layer of the substrate.

13. The switch of claim 1, wherein the signal electrode comprises a plurality of resistive elements, wherein each resistive element is selectively engaged by a moving contact line of the droplet.

14. The switch of claim 1, wherein one of the signal electrodes comprises a contact electrode, wherein the droplet is in electrical contact with the contact electrode at all times during switch actuation.

15. The switch of claim 1, wherein the frame comprises a plurality of walls or posts formed on the substrate and in contact with the droplet, wherein the plurality of walls or posts constrain translation of the droplet.

16. A switch comprising:

a substrate configured as a coplanar waveguide having a first ground portion, a signal portion, and a second ground portion, the first and second ground portions including respective ground electrodes, the signal portion being operatively coupled to first and second signal electrodes;

a first actuation electrode disposed beneath the upper surface of the substrate adjacent to the first ground portion, the first actuation electrode operatively coupled to drive circuitry;

a second actuation electrode disposed beneath the upper surface of the substrate adjacent to the second ground portion, the second actuation electrode operatively coupled to drive circuitry; and a first frame disposed on or above an upper surface of the substrate and configured to hold a first droplet in substantially the same location over the first ground portion;

a second frame disposed on or above an upper surface of the substrate and configured to hold a second droplet in substantially the same location over the second ground portion; and wherein actuation of the first and second actuation electrodes electrically connects the first droplet with the first signal electrode and electrically connects the second droplet with the second signal electrode.

17. The switch according to claim 16, wherein when the switch is in a non-actuated state, the first frame maintains a substantially constant gap between a contact line of the first droplet and the first signal electrode and the second frame maintains a substantially constant gap between a contact line of the second droplet and the second signal electrode.

18. The switch according to claim 17, wherein the substantially constant gap is a distance within the range of less than 100 μm.

19. The switch according to claim 17, wherein the first frame includes a first opening configured to define a first portion of the first droplet meniscus and a second opening configured to define a second portion of the first droplet meniscus, wherein the second opening is larger than the first opening and wherein the second frame includes a first opening configured to define a first portion of the second droplet meniscus and a second opening configured to define a second portion of the second droplet meniscus, wherein the second opening is larger than the first opening.

20. The switch of claim 16, further including a heater configured to heat the switch.

21. The switch of claim 20, further comprising at least one heating element disposed beneath the upper surface of the substrate, the at least one heating element being configured to heat a dielectric layer of the substrate.

22. The switch of claim 16, wherein one or both of the first and second signal electrodes comprises a plurality of resistive elements, wherein each resistive element is selectively engaged by a moving contact line of the respective droplets.

23. A method of switching comprising:

providing a switch comprising a substrate having an upper surface containing at least one signal electrode, the switch including at least one actuation electrode disposed beneath the upper surface of the substrate and operatively coupled to drive circuitry, the switch further comprising a frame disposed on or above the upper surface of the substrate and configured to hold a droplet, wherein the frame is configured to produce a droplet having a first meniscus portion with a smaller radius of curvature than a second meniscus portion, the first meniscus portion forming a contact line that is moveable to selectively engage the at least one signal electrode;

activating the at least one actuation electrode to move a contact line of the droplet in electrical contact with the signal electrode, wherein the droplet remains in substantially the same location during actuation of switch and wherein the contact line of the droplet is in electrical contact with the signal electrode within 50 μs of activating the at least one actuation electrode.

24. The method of claim 23, further comprising heating the switch.

25. The method of claim 23, further comprising deactivating the at least one actuation electrode to move the contact line of the droplet formed with the surface away from the at least one signal electrode.

26. The method of claim 23, wherein during actuation, a contact line of the droplet moves initially at a first speed and later at a second speed slower than the first speed and wherein the droplet contacts the at least one signal electrode when moving at the first speed.

27. A switch comprising:

a substrate having an upper surface containing at least one signal electrode;

at least one actuation electrode disposed beneath the upper surface of the substrate; the at least one actuation electrode operatively coupled to drive circuitry;

a frame disposed on or above the upper surface of the substrate and configured to hold a droplet in substantially the same location during actuation of the switch; and a heater configured to heat the switch, wherein the heater comprises at least one heating element disposed beneath the upper surface of the substrate, the at least one heating element being configured to heat a dielectric layer of the substrate.

28. A switch comprising:

a substrate having an upper surface containing at least one signal electrode;

at least one actuation electrode disposed beneath the upper surface of the substrate; the at least one actuation electrode operatively coupled to drive circuitry;

a frame disposed on or above the upper surface of the substrate and configured to hold a droplet in substantially the same location during actuation of the switch; and wherein the signal electrode comprises a plurality of resistive elements, wherein each resistive element is selectively engaged by a moving contact line of the droplet.

* * * * *